US011457761B2

(12) United States Patent
Sundelin et al.

(10) Patent No.: US 11,457,761 B2
(45) Date of Patent: Oct. 4, 2022

(54) DRAPERY SYSTEM AND A METHOD FOR MOUNTING A DRAPERY TRACK

(71) Applicant: BLINDSPACE AB, Smälandsstenar (SE)

(72) Inventors: Anders Sundelin, Mölndal (SE); Gaius Henry Guest, Kungsbacka (SE)

(73) Assignee: BLINDSPACE AB, Smalandsstenar (SE)

( * ) Notice: Subject to any disclaimer, the term of this patent is extended or adjusted under 35 U.S.C. 154(b) by 0 days.

(21) Appl. No.: 16/928,203

(22) Filed: Jul. 14, 2020

(65) Prior Publication Data

US 2022/0015563 A1 Jan. 20, 2022

(51) Int. Cl.
*A47H 1/08* (2006.01)
*A47H 1/104* (2006.01)

(52) U.S. Cl.
CPC ..... *A47H 1/08* (2013.01); *A47H 1/104* (2013.01)

(58) Field of Classification Search
CPC ..... A47H 1/08; A47H 1/104; Y10T 16/375; Y10T 16/379; E06B 9/323
See application file for complete search history.

(56) References Cited

U.S. PATENT DOCUMENTS 3,129,751 A * 4/1964 Weber ..... A47H 1/06 160/345
3,346,909 A 10/1967 Blackburn
3,431,585 A * 3/1969 Foltz ..... E05D 15/0652 16/94 D
3,715,776 A * 2/1973 Tanaka ..... A47H 1/04 16/94 D
3,913,204 A * 10/1975 Finkbeiner ..... A47H 7/00 29/241
4,023,235 A * 5/1977 Cohen ..... A47H 1/04 16/96 D
4,821,370 A * 4/1989 Magdars ..... A47H 1/04 16/94 D
5,259,520 A * 11/1993 Roggio ..... A47H 1/04 16/94 D (Continued)

FOREIGN PATENT DOCUMENTS

DE 2222017 A1 11/1973
DE 2435301 A1 2/1976

(Continued)

OTHER PUBLICATIONS

International Search Report (dated Aug. 16, 22021) for corresponding International App. PCT/SE2021/050555.

*Primary Examiner* — Victor D Batson
*Assistant Examiner* — Matthew J Sullivan
(74) *Attorney, Agent, or Firm* — WRB-IP LLP

(57) ABSTRACT

A drapery system includes an elongate support member which defines an elongate space for housing a drapery track, wherein the elongate support member includes a first elongate plate-shaped portion which extends in a longitudinal direction of the elongate support member and defines the elongate space in one direction, wherein the elongate support member includes at least one connector projecting from the first plate-shaped portion in the elongate space, and wherein the drapery system includes a connection structure which is adapted for engagement with the drapery track and with the at least one connector.

17 Claims, 13 Drawing Sheets

(56) References Cited

U.S. PATENT DOCUMENTS

| | | | | |
|---|---|---|---|---|
| 6,427,286 | B1 * | 8/2002 | Erskine | E05D 15/0647 16/93 R |
| 6,467,127 | B1 * | 10/2002 | Goldstein | A47H 1/022 16/87 R |
| 6,647,590 | B2 * | 11/2003 | Haab | E05D 15/0652 16/94 R |
| 8,210,369 | B2 * | 7/2012 | Hibshman | E06B 9/362 211/105.1 |
| 8,584,317 | B2 * | 11/2013 | Liebscher | E05F 15/641 49/425 |
| 8,776,317 | B2 * | 7/2014 | Atwell | A47H 1/04 16/94 R |
| 9,644,422 | B2 * | 5/2017 | Marocco | E06B 9/262 |
| 2002/0044824 | A1 | 4/2002 | Haab et al. | |
| 2006/0101745 | A1 * | 5/2006 | Kleege | E04B 2/827 52/243.1 |
| 2016/0374496 | A1 * | 12/2016 | Marcinik | A47H 1/08 160/331 |
| 2018/0245389 | A1 * | 8/2018 | Andersson | A47H 15/04 |

FOREIGN PATENT DOCUMENTS

| | | | |
|---|---|---|---|
| DE | 3327024 | A1 | 2/1985 |
| JP | 53132126 | A | 11/1978 |
| JP | 0691861 | B1 | 11/1994 |

* cited by examiner

DRAPERY SYSTEM AND A METHOD FOR MOUNTING A DRAPERY TRACK

BACKGROUND AND SUMMARY

The invention relates to a drapery system for mounting in a ceiling. The drapery system comprises an elongate support member, which defines an elongate space for housing a drapery track. The elongate support member may be built into the ceiling during construction of a building so that it is prepared for a later selection of a drapery track solution. The drapery track is then fitted inside the elongate support member after construction work is completed. Alternatively, the elongate support member may be built into the ceiling subsequently as a retrofit at the point in time of mounting the drapery track. In either way, the drapery track may be arranged recessed in the ceiling, preferably so that a lower surface of the drapery track is flush with the ceiling.

The term "drapery" refers to a sheet of material, such as a cloth or textile, used for decorative purposes, such as around windows. The drapery is connected to the drapery track via runners, such as rollers or gliders, which are moveably arranged in the longitudinal direction of the drapery track. When installed, the drapery hangs below the drapery track close to the finished ceiling. Another term for "drapery" may be "curtain" or "drape".

According to one piece of prior art, the elongate support member comprises a back wall and two side walls, which extend perpendicularly relative to the back wall, wherein the back wall and side walls jointly define the elongate space. The elongate support member may be a one-piece unit formed by extrusion. The back wall comprises a hook, that projects in the elongate space for engagement with a correspondingly shaped hook of the drapery track. During mounting, the drapery track is hanged onto the elongate support member via the hooks. Further, a wedge is arranged in the elongate space sideways of the drapery track in contact with the associated side wall and the drapery track so that the hooks are maintained in engagement. Such a wedge solution results in that the drapery track is not centred with regard to a centre plane of the elongate support member. Further, the lower surface of the wedge will be visible when mounted. Further, the interface between the wedge and the side wall of the elongate support member and the drapery track, respectively, will form visible demarcation lines. In summary, the wedge solution is associated to different issues from an aesthetic perspective.

According to an aspect of the invention, a drapery system comprises an elongate support member, which defines an elongate space for housing a drapery track, wherein the elongate support member comprises a first elongate plate-shaped portion, which extends in a longitudinal direction of the elongate support member and defines the elongate space in one direction, wherein the elongate support member comprises at least one connector projecting from the first plate-shaped portion in the elongate space, and wherein the drapery system comprises a connection structure, which is adapted for engagement with the drapery track and with the at least one connector.

Due to the connector and a proper design of the elongate support member and the connection structure, the connection structure may be arranged concealed by the drapery track in the elongate support member. Thus, the connection structure may be arranged inside of the drapery track in an interior of the elongate support member. It creates conditions for an aesthetically attractive solution.

Further, the connector creates conditions for first connecting the connection structure to the drapery track and then to position the drapery track in the elongate space and rigidly attach the connection structure to the elongate support member via the connector. It creates conditions for a facilitated assembly. Further, by rigidly attaching the connection structure to the elongate support member, there is a reduced risk of damaging the drapery track during assembly in relation to solutions where the drapery track is directly attached to the elongate support member via fasteners. More specifically, this aspect creates conditions for mounting the drapery track in the elongate support member manually by means of a screw driver. Access to the connection structure for rigidly attaching it to the elongate support member via the screw driver may be through an elongate slot of the drapery track, which is adapted for receipt of drapery runners in operation.

Further, the connection structure may be tailored for fitting drapery tracks of different designs and dimensions, such as from different manufacturers, in the elongate support member. According to one aspect of the disclosure, a single design of the elongate support member may be associated to a plurality of different designs of the connection structure so that a lower surface of the drapery track is flush with the ceiling irrespective of the height of the drapery track.

Further, the elongate support member may have a longitudinal extension along a straight line and be substantially rigid. Further, the elongate support member may be formed in a metallic material such as aluminium and be produced via extrusion.

Further, the elongate support member may be adapted to be attached to the ceiling in a fixed state via one or several connection means, like screws or rivets or glue.

Further, an inner distance between opposite side walls of the elongate support member may be larger than an outer dimension of the drapery track in a width direction. In such a situation, the design creates conditions for arranging the drapery track in a desired position in a width direction of the elongate support member. According to one example, the at least one connector of the elongate support member, the connection structure and the drapery track may be adapted so that the drapery track will be centred in the elongate support member independent of how wide the drapery track is. Thus, the gaps on the sides would be identical. It creates conditions for an aesthetically attractive solution.

According to one embodiment example, the at least one connector is elongate and extends in a longitudinal direction of the elongate support member. It creates conditions for an efficient production since the elongate support member and the connector may be a one-piece unit and produced via extrusion.

According to another embodiment example, the at least one connector comprises two parallel projections, which are spaced in a width direction of the elongate support member. It creates conditions for a facilitated mounting of the drapery track in that the connection structure may be supported from two sides by the two parallel projections.

According to a further development of the last-mentioned embodiment example, the two parallel projections are spaced at such a distance that a fastener of screw-type may engage both projections simultaneously. According to one aspect, the connection structure comprises a plurality of fasteners, which are adapted to attach the drapery track to the elongate support member at spaced positions in a longitudinal direction of the elongate support member.

According to a further development of the last-mentioned embodiment example, an inner surface of at least one of the two parallel projections, which faces the other projection, is provided with a ridge-valley configuration for facilitating engagement with the fastener.

According to another embodiment example, the connection structure is adapted to be a spacer between the elongate support member and the drapery track, wherein the connection structure comprises a first contact surface for contacting an inner surface of the elongate support member in a first direction and a second contact surface for contacting the drapery track in a second direction, which is opposite the first direction, and that the connection structure has an extension between the first contact surface and the second contact surface that is adapted to a height of the drapery track so that a lower surface of the drapery track is substantially flush with a lower surface of the elongate support member. It creates further conditions for an aesthetically attractive solution.

According to another embodiment example, the connection structure comprises a first body, which is adapted to be positioned between the drapery track and the first elongate plate-shaped portion of the elongate support member. According to one aspect, the first body has an extension in a width direction substantially the same as or somewhat smaller than a width extension of the drapery track. According to one aspect, the first body has an extension in a height direction substantially smaller than a height extension of the drapery track. According to one aspect, the first body has a generally rectangular shape in a main extension plane, wherein a dimension of the first body is such that opposite side edges of the rectangular first body engages opposite walls of the drapery track.

According to a further development of the last-mentioned embodiment example, the first body comprises two support surfaces, which are spaced in a width direction of the connection structure, for engagement with two engagement hooks projecting from the drapery track facing each other. According to one aspect, the two support surfaces face in a height direction of the first body and are provided on the same side of the first body. The first body may then be slid along the drapery track to its intended longitudinal position.

According to a further development of the last-mentioned embodiment example, the first body comprises a connection means, which is accessible from a side of the body portion, which is adapted to face the drapery track. The drapery track may be produced with through holes in its height direction or such holes may be formed by drilling subsequently to production, such as at the point in time of mounting the drapery track. The connection structure is then positioned relative to the drapery track so that the connection means is in line with the through holes.

According to a further development of the last-mentioned embodiment example, the connection means comprises a through-hole and wherein the connection structure comprises a fastener for being received in the through hole and fastening to the at least one connector of the elongate support member. By rigidly attaching the connection structure to the elongate support member, there is a reduced risk of damaging the drapery track during assembly in relation to solutions where the drapery track is directly attached to the elongate support member via fasteners. A conventional screw driver may be used for attaching the drapery system to the elongate support member.

According to a further development of the last-mentioned embodiment example, the connection means comprises a widened recess at an end of the through hole, which is adapted for facing the drapery track for receipt of a head of the fastener.

According to another embodiment example, the connection structure comprises a plurality of first bodies, which are adapted for being arranged in a spaced relationship in a longitudinal direction of the elongate support member, wherein the spacing is matched to a through-hole spacing in the drapery track. According to one example, each first body comprises a single through hole for being arranged in line with an associated through hole of the drapery track.

According to an alternative embodiment example, each one of the two parallel projections have a hook shape in cross section, wherein the hooks face each other. According to one aspect, the hooks are arranged in a mirrored relationship with regard to a centre plane of the elongate support member. Such a design creates conditions for supporting the drapery system via a different type of connection structure.

According to a further development of the last-mentioned embodiment example, the connection structure is adapted for at least partly being turned between a first assembly position and a second fixed position in a plane parallel to a plane defined by the hook shaped projections for engagement with the hooks in the second fixed position.

According to a further development of the last-mentioned embodiment example, the connection means comprises a second body, which is pivotably arranged relative to the first body and wherein the second body comprises two spaced support surfaces for engagement with the two hook shaped projections projecting from the first plate-shaped portion.

According to another embodiment example, the first plate-shaped portion forms a back section of the elongate support member and wherein the elongate support member comprises a second and third plate-shaped portion, which extend perpendicularly relative to the first plate-shaped portion and are spaced in a width direction of the elongate support member and wherein the first, second and third plate-shaped portions define the elongate space.

Thus, the first, second and third plate-shaped portions define an elongated aperture extending in parallel with the longitudinal direction of the elongate support member forming the space for the drapery track. Preferably, each one of the plate-shaped portions has a rectangular shape. Each one of the plate-shaped portions may be elongated with a longitudinal direction in parallel with a longitudinal direction of the elongate support member. According to one aspect, the plate-shaped portions are of the same length and are formed in a one-piece unit. In other words, the elongate support member may form a profile with constant cross section along its extension direction comprising the plate-shaped portions.

According to one example, the at least one connector is arranged about midway between the second and third plate-shaped portions. By also arranging the connection means of the connection structure in a position about midway in a width direction of the connection structure and providing an associated through hole in the drapery track, which overlaps with the connection means, for accessing the connection means, the drapery track may be arranged centred in the elongate support member. In this way, any gaps between the drapery track and the elongate support member sideways of the drapery track would be identical. It creates conditions for an aesthetically attractive solution.

According to a further development of the last-mentioned embodiment example, the drapery system comprises the drapery track and wherein the spacing between the second and third plate-shaped portion in the width direction of the elongate support member is the same or somewhat larger than an extension of the drapery track in its width direction for a close fit of the drapery track between the second and third plate-shaped portions.

Further, the drapery track may have a longitudinal extension along a straight line and be substantially rigid. Further, the drapery track may be formed in a metallic material such as aluminium and be produced via extrusion.

According to a further development of the last-mentioned embodiment example, the drapery system comprises the drapery track, wherein the drapery track comprises an elongate slot, which slot is adapted for receipt of drapery runners, and wherein the drapery track is positioned in such a way relative to the connection structure that the connection means of the connection structure is accessible via the elongate slot.

According to another aspect of the invention, a method is provided for mounting a drapery system in a ceiling, which creates conditions for a facilitated assembly. The method comprises the consecutive steps of engaging a connection structure with the drapery track, positioning the drapery track with the engaged connection structure in an elongate space of an elongate support member, and connecting the drapery track to the elongate support member by fastening the connection structure to the elongate support member via an elongate slot of the drapery track, which slot is adapted for receipt of drapery runners during operation.

Further advantages and advantageous features of the invention are disclosed in the following description and in the claims.

BRIEF DESCRIPTION OF THE DRAWINGS

With reference to the appended drawings, below follows a more detailed description of embodiments of the invention cited as examples.

In the drawings.

DETAILED DESCRIPTION

Figure 1A:
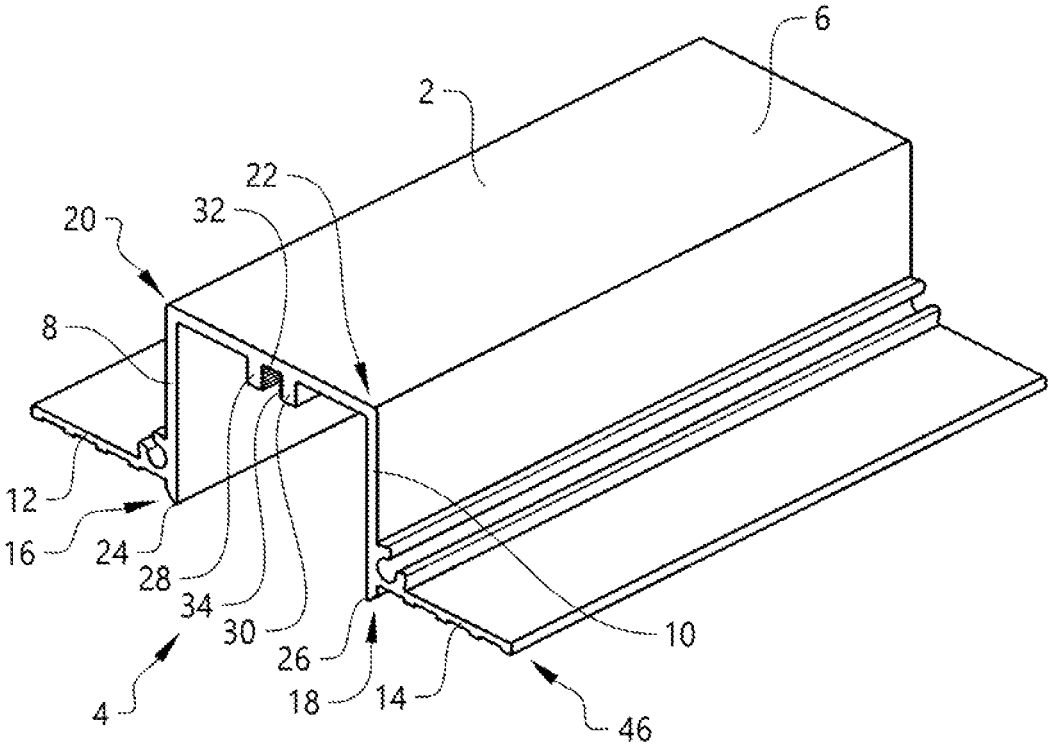
FIG. 1*a* is a perspective view from the top of an elongate support member according to a first embodiment.

FIG. 1*a* is a perspective view from the top of an elongate support member 2 according to a first embodiment. The elongate support member 2 defines an elongate space 4 for housing a drapery track. The elongate support member 2 comprises a first elongate plate-shaped portion 6, which extends in a longitudinal direction of the elongate support member 2 and defines the elongate space in one direction. The first plate-shaped portion 6 forms a back section of the elongate support member 2. The elongate support member 2 further comprises a second and third elongate plate-shaped portion 8,10, which extend perpendicularly relative to the first plate-shaped portion and are spaced in a width direction of the elongate support member and wherein the first, second and third plate-shaped portions 6,8,10 define the elongate space.

Further, the elongate support member 2 comprises a fourth and fifth plate-shaped portion 12,14, which form skim coat flanges. The fourth and fifth plate-shaped portion 12,14 extend in the same plane, which is parallel to a plane defined by the first plate-shaped portion 6. The fourth and fifth plate-shaped portion 12,14 are connected to the second and third plate-shaped portion 8,10, respectively, adjacent a first end 16,18 which is distant from a second end 20,22 connected to the first plate-shaped portion 6.

The first end 16 of the second plate-shaped portion 12 is tapering towards a free edge 24. Likewise, the first end 18 of the third plate-shaped portion 14 is tapering towards a free edge 26. The tapering creates conditions for an aesthetically attractive arrangement of the elongate support member 2 in the ceiling in that a thickness of the plate shaped element at the edge may be thin, wherein only the thin edge may be visible after mounting in the ceiling and application of skim plaster coat or possibly the edge may be covered altogether by the skim plaster coat and thereby not visible at all. Further, the tapering creates conditions for a robust production in that the elongate support member, possibly except for the tapering section (depending on the material thickness at the smallest cross section), may be produced in a conventional way, such as via extrusion. The tapering design may be achieved via machining/cutting/chamfering an end portion of the plate shaped member so that the desired tapering shape towards the edge is formed.

Further, finishing of the ceiling after mounting of the elongate support member may be facilitated in that skim plaster coat may be applied in an easy and time-efficient way by scraping skim plaster coat via a tool against the edge. Thus, the elongate support member allows for the skim plaster coat to be applied flush with the edge.

Further, the elongate support member 2 comprises two connectors 28,30 projecting from the first plate-shaped portion 6 in the elongate space 4. The connectors 28,30 are elongate and extends in a longitudinal direction of the elongate support member 2. The two connectors 28,30 are formed by two parallel projections, which are spaced in a width direction of the elongate support member 2. More specifically, the two parallel projections 28,30 are spaced at such a distance that a fastener of screw-type may engage both projections simultaneously. Further, an inner surface 32,34 of each one of the two parallel projections 28,30 is provided with a ridge-valley configuration for facilitating engagement with the fastener.

Figure 1B:
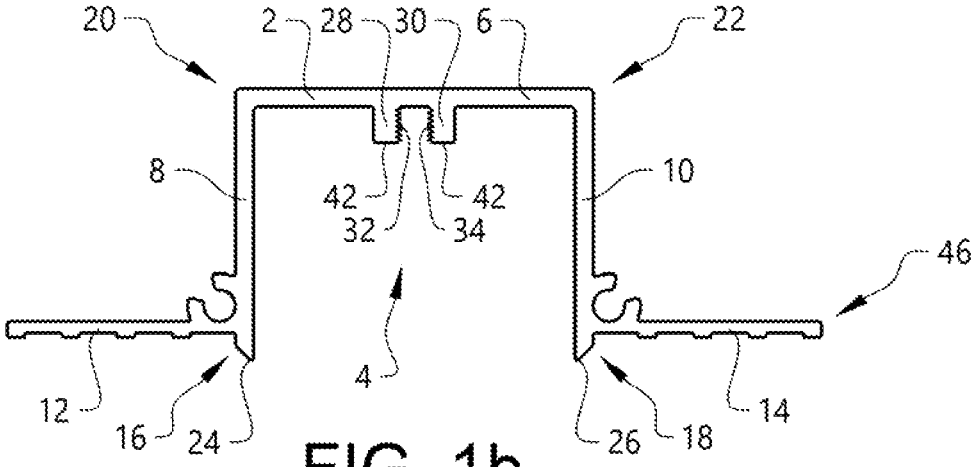
FIG. 1*b* is a cross section view of the elongate support member according to the first embodiment.

FIG. 1*b* is a cross section view of the elongate support member 2 according to the first embodiment.

Figure 2A:
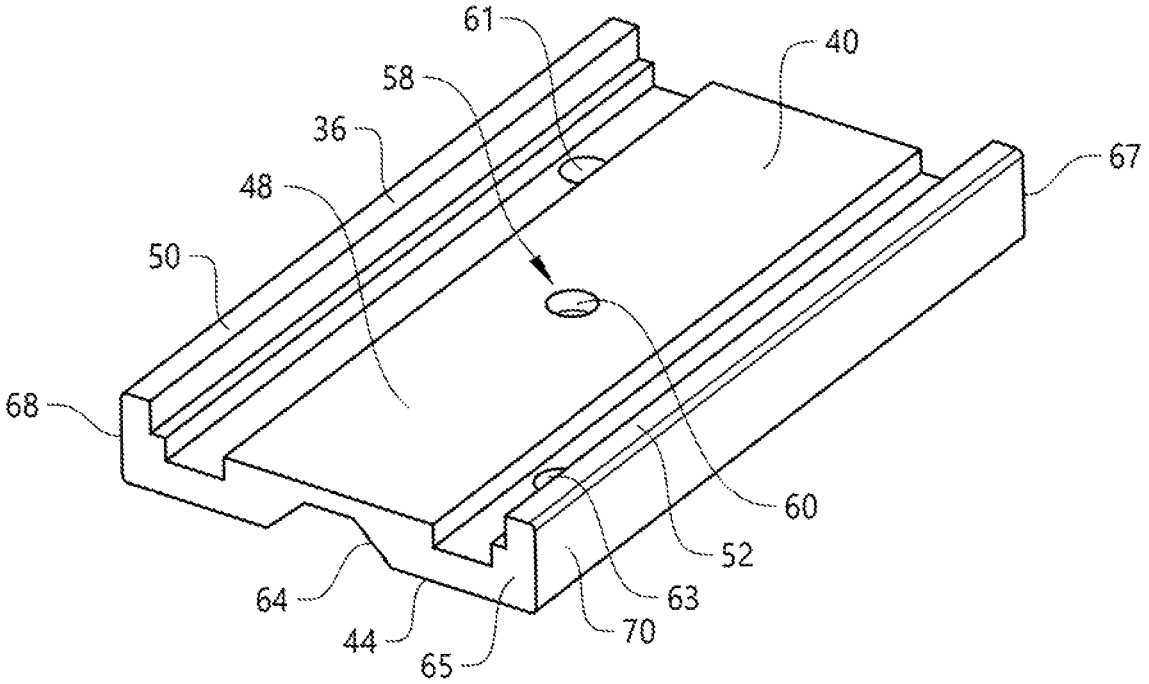
FIG. 2*a* is a perspective view from the top of a support structure according to a first embodiment.

FIG. 2*a* is a perspective view from the top of a support structure 36 according to a first embodiment. The support structure 36 is adapted for engagement with a drapery track 38, see FIGS. 3*a* and 3*b*, and with the at least one connector. 28,30. More specifically, the connection structure 36 is adapted to be a spacer between the elongate support member 2 and the drapery track 38 in a height direction of the elongate support member 2.

The connection structure 36 comprises a first contact surface 40 for contacting an inner surface 42 of the elongate support member 2 in a first direction and a second contact surface 44 for contacting the drapery track 38 in a second direction, which is opposite the first direction. The connection structure 36 has an extension between the first contact surface 40 and the second contact surface 44 that is adapted to a height of the drapery track 38 so that a lower surface of the drapery track 38 is substantially flush with a lower surface 46 of the elongate support member 2.

The connection structure 36 comprises a first body 48, which is adapted to be positioned between the drapery track 38 and the first elongate plate-shaped portion 6 of the elongate support member 2. The first body 48 comprises two support surfaces 50,52, which are spaced in a width direction of the connection structure 36, for engagement with two engagement hooks 54,56 projecting from the drapery track 38 facing each other. The two support surfaces 50,52 faces in the same direction.

Further, the first body 48 comprises a connection means 58, which is accessible from a side of the body 48, which is adapted to face the drapery track 38. The connection means 58 comprises a through-hole 60. Further, the connection structure 36 comprises a fastener 62, see FIGS. 6*f* and 6*g*, for being received in the through hole 60 and fastening to the at least one connector 28,30 of the elongate support member 2. The connection means 58 comprises a widened recess 64 at an end of the through hole, which is adapted for facing the drapery track 38 for receipt of a head 66 of the fastener. Thus, the surface defining the widened recess 64 forms a support surface for contacting a surface of the head 66 so that the head 66 is completely recessed in the first body in an assembled state. The widened recess 64 forms an elongate recess extending along the complete length of the first body 48.

The first body 48 has a generally rectangular shape in a main extension plane, wherein a dimension of the first body is such that opposite side edges 68,70 of the rectangular first body 48 engages opposite walls of the drapery track 38. More specifically, upper surfaces of the side edges 68,70 form the two support surfaces 50,52. The through hole 60 is located about midway between the side edges 68,70. Further, the through hole 60 is located about midway between opposite side surfaces 65,67 in a longitudinal direction of the connection structure 3

Further, the first body 48 comprises at least one further through hole 61,63 for receipt of a fastener for attaching the first body 48 to a desired position relative to the drapery track 38. The two holes 61,63 are arranged on opposite sides of the central through hole 60 in a width direction of the first body 48. Further, the two holes 61,63 are arranged on opposite sides of the central through hole 60 in a length direction of the first body 48. In this way, the first body 48 may be securely attached to the drapery track 38 in any desired position in the longitudinal direction of the drapery track 38.

Figure 2B:
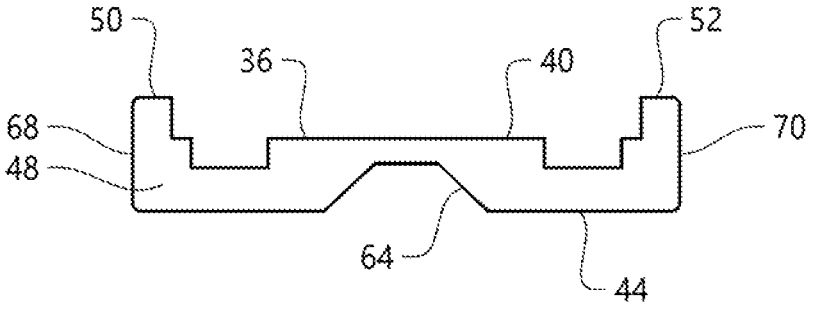
FIG. 2*b* is a cross section view of the support structure according to the first embodiment.

FIG. 2*b* is a cross section view of the support structure 36 according to the first embodiment.

Figure 3A:
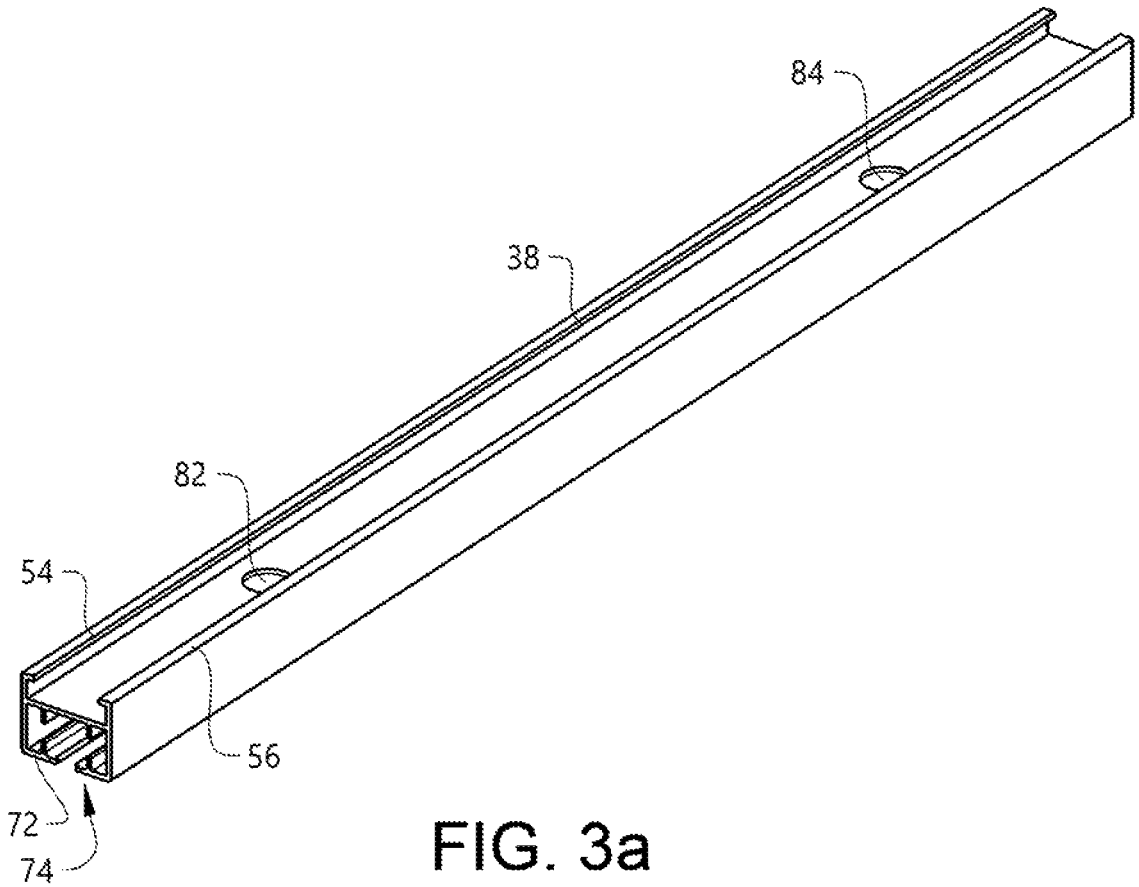
FIG. 3*a* is a perspective view from the top of a drapery track according to a first embodiment.

FIG. 3*a* is a perspective view from the top of the drapery track 38 according to a first embodiment. The drapery track 38 is elongate and comprises an elongate inner space 72 for receipt of a set of drapery runners. Further, the drapery track 38 comprises a slot 74 extending in a longitudinal direction of the drapery track 38, which slot 74 is in communication with the inner space 72 so that a lower portion of the runners may extend out through the slot 74. A drapery may be connected to the lower portions of the runners. Further, the drapery track 38 comprises an elongate chamber 76,78 on either side of the inner space 72. The elongate chambers 76,78 are in communication with the inner space 72 in a width direction of the drapery track 38. The elongate chambers 76,78 are adapted for receipt of a belt, which in turn is connected to the runners for moving the runners along the drapery track.

More specifically, the drapery track 38 comprises a lower wall 79 and an upper wall 80, which defines the inner space 72 in a height direction of the drapery track. The slot 74 is arranged through the lower wall 79.

Further, the drapery track 38 comprises the two engagement hooks 54,56 projecting in a height direction from the upper wall 80 of the drapery track 38. The two engagement hooks 54,56 are arranged in a mirrored relationship with regard to a vertical centre plane of the drapery track 38. The two engagement hooks 54,56 are directed towards the centre plane. The space between the hooks 54,56 forms a receipt for the first body 48 of the connection structure 36.

A plurality of longitudinally spaced through holes 82,84 are arranged through the upper wall 80. The through holes 82,84 form access openings for accessing the connection means 58 of the first body 48 during mounting. The through holes 82,84 are substantially larger than the associated through holes 60 of the first body 48. More specifically, the through holes 82,84 in the upper wall 80 are sized for receipt of a stem of a manual screw driver.

Figure 3B:
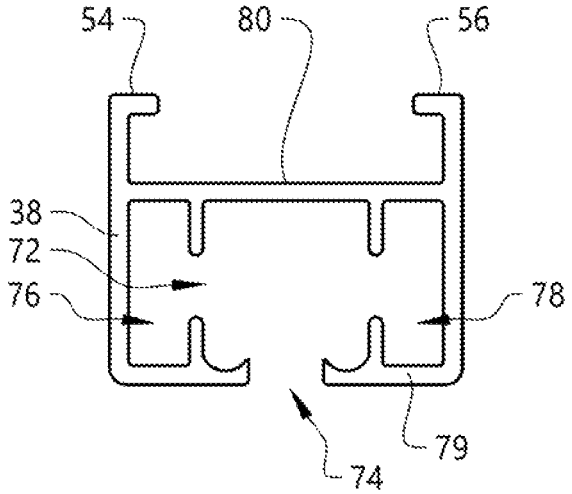
FIG. 3*b* is a cross section view of the drapery track according to the first embodiment.

FIG. 3*b* is a cross section view of the drapery track 38 according to the first embodiment.

Figure 4A:
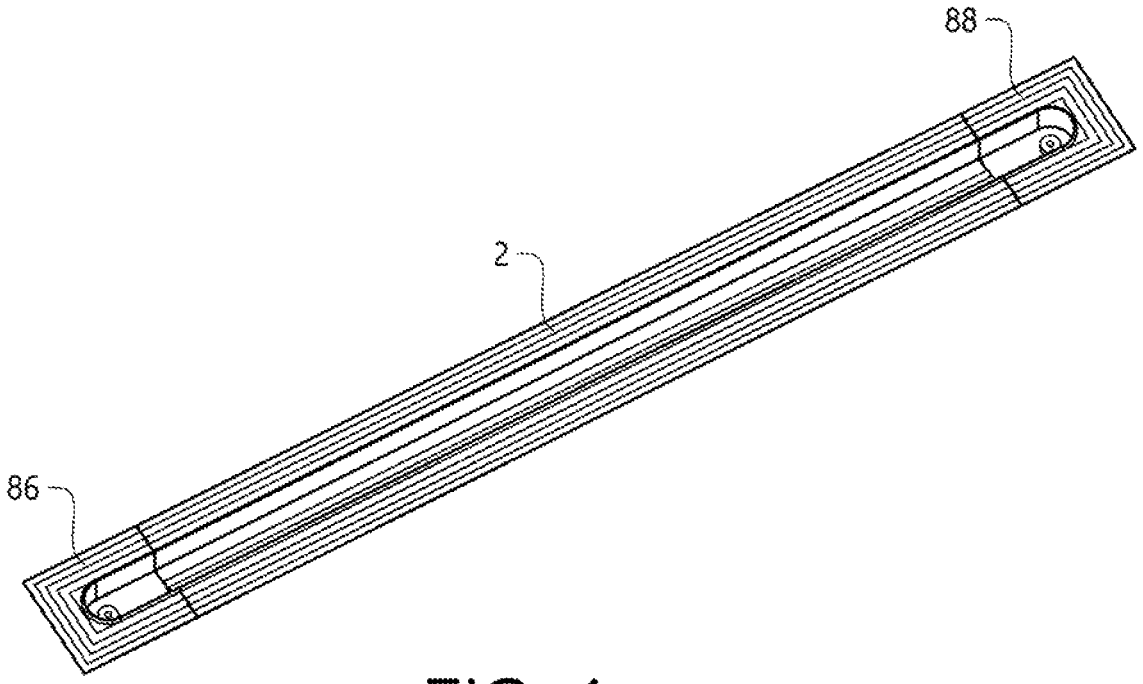
FIG. 4*a* is a perspective view from below of the elongate support member according to the first embodiment with an end section at either end according to one aspect.

FIG. 4*a* is a perspective view from below of the elongate support member 2 according to the first embodiment with an end section 86,88 at either end according to one aspect. The end sections 86,88 are adapted for receipt of a corresponding end section of a drapery track for belt return.

Figure 4B:
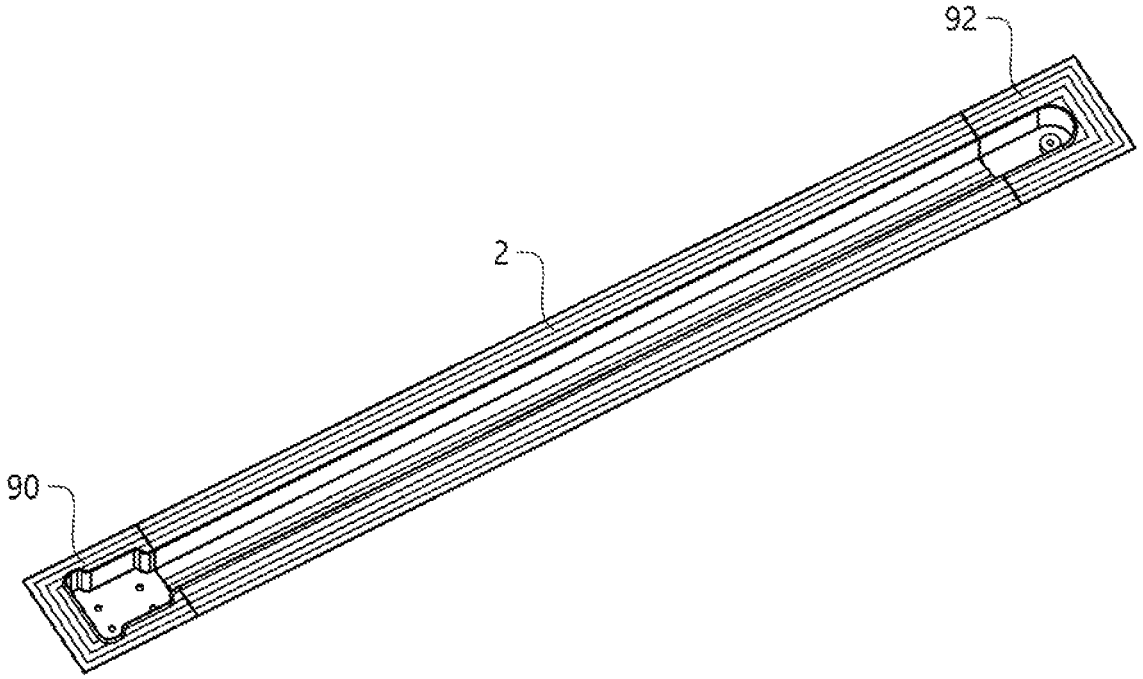
FIG. 4*b* is a perspective view from below of the elongate support member according to the first embodiment with an end section at either end according to an alternative aspect.

FIG. 4*b* is a perspective view from below of the elongate support member 2 according to the first embodiment with an end section 90,92 at either end according to an alternative aspect. A first one of the end sections 90 is adapted for receipt of a motor for motorized operation of the drapery. A second one of the end sections 92 is adapted for receipt of a corresponding end section of a drapery track for belt return.

Figure 5A:
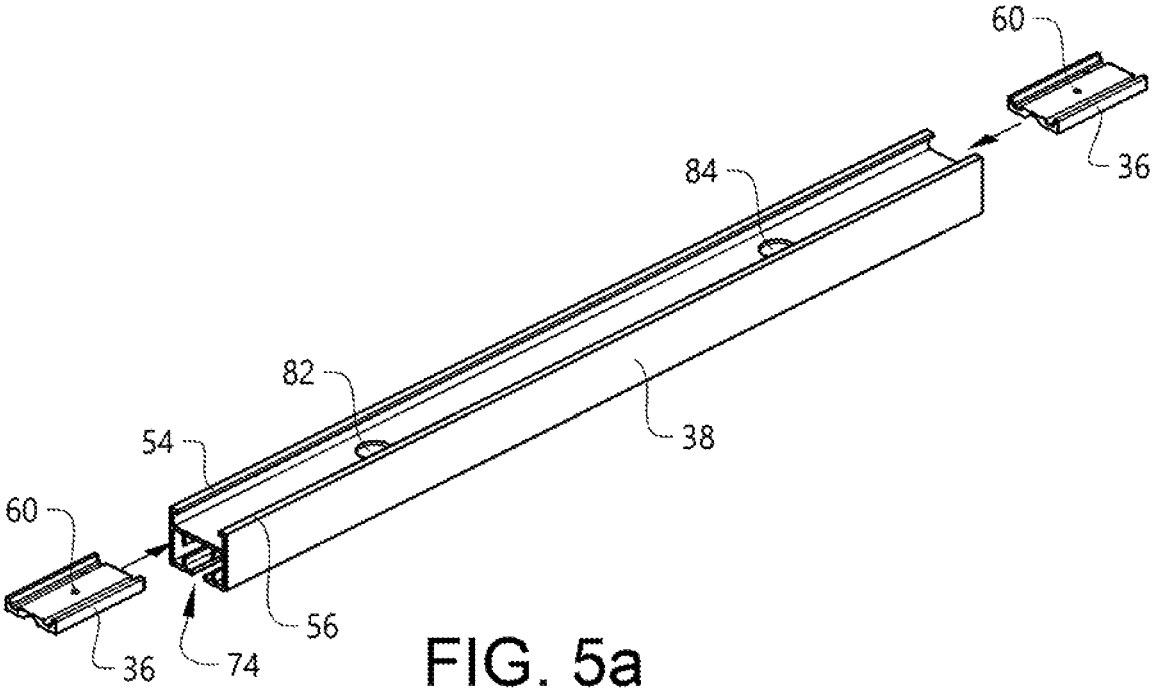
FIG. 5*a* is a perspective view from the top of the drapery track and the support structure according to the first embodiment in an intermediate assembly step.
Figure 5B:
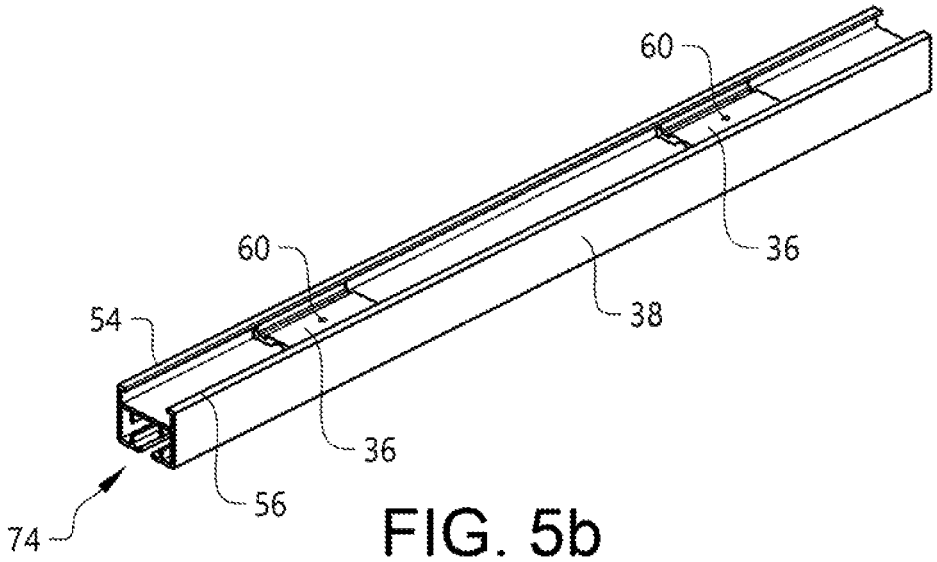
FIG. 5*b* is a perspective view from the top of the drapery track and the support structure according to FIG. 5*a* in an assembled state.

FIG. 5*a* is a perspective view from the top of the drapery track 38 and the support structure 36 according to the first embodiment in an intermediate assembly step. The support structure 36 is positioned under the hooks 54,56 at an end of the drapery track in its longitudinal direction and slid along the drapery track 38 to a desired position, in which the through hole 60 of the body 48 overlaps one of the access holes 82,84 of the drapery track 38. The body 48 is then attached in this position via a fastener (not shown) applied in the through holes 61,63. FIG. 5*b* is a perspective view from the top of the drapery track 38 and the support structure 36 according to FIG. 5*a* in an assembled state. Thus, the connection means 58 (through hole 60) of the connection structure 36 is accessible via the elongate slot 74.

FIG. 6*a-e* are perspective views from below of a part of a room, comprising a window 94 and a ceiling 96 with an elongate opening 98 in the ceiling in consecutive assembly steps of a drapery system 100 according to a first embodiment. The elongate opening 98 in the ceiling is preferably arranged during construction of the building. The elongate opening 98 in the ceiling 96 is adapted and dimensioned for receipt of the elongate support member 2.

Figure 6A:
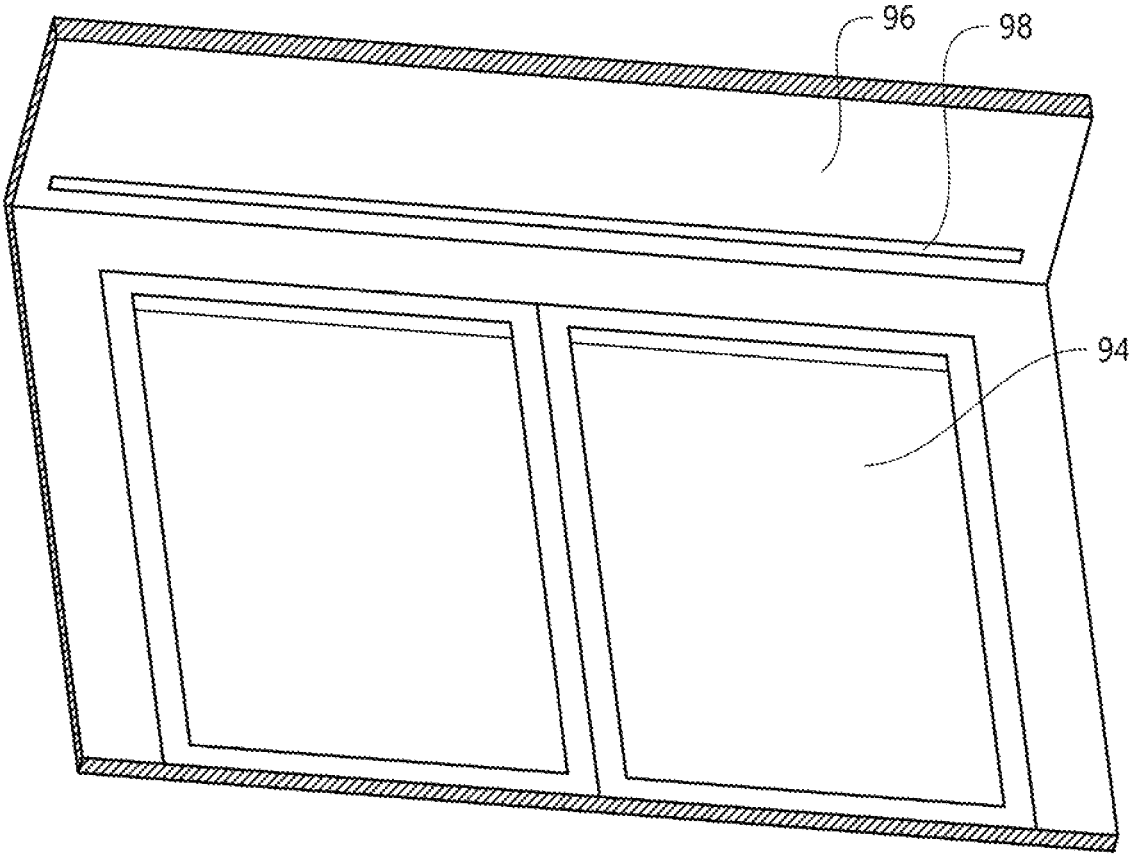
FIG. 6*a-e* are perspective views from below of a part of a room, comprising a window and a ceiling with an elongate opening in the ceiling in consecutive assembly steps of a drapery system according to a first embodiment.
Figure 6B:
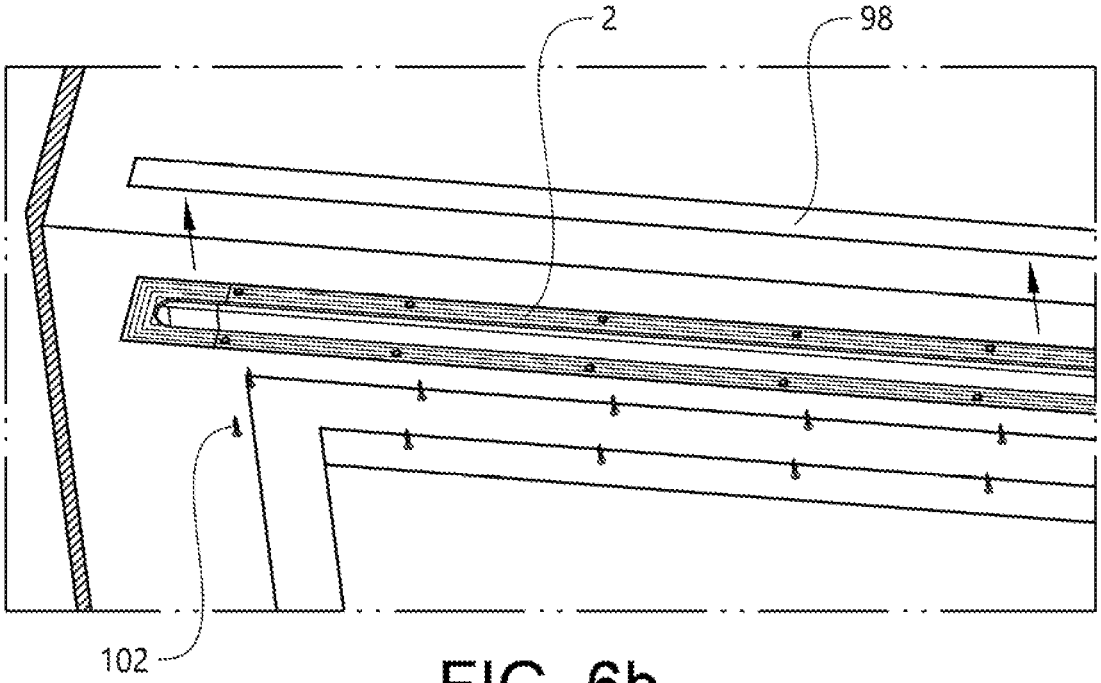

In FIG. 6*b*, the elongate support member 2 is positioned in the elongate opening 98 and fastened to the ceiling via anchoring fasteners 102 in the form of screws.

Figure 6C:
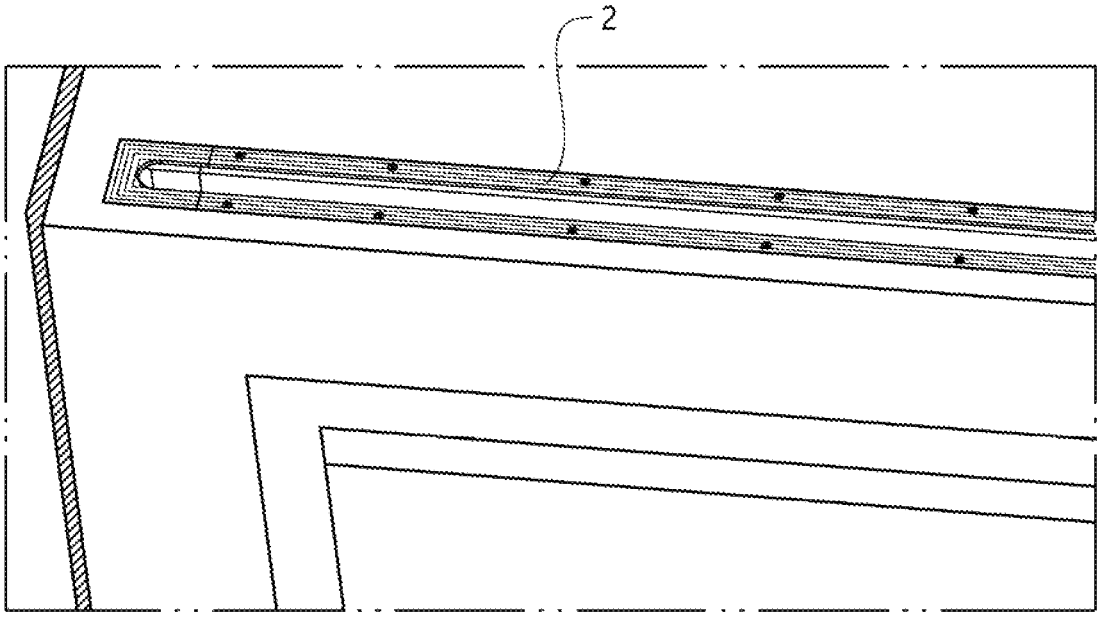

FIG. 6*c* discloses the elongate support member 2 received in the elongate ceiling opening 98 in an assembled state.

Figure 6D:
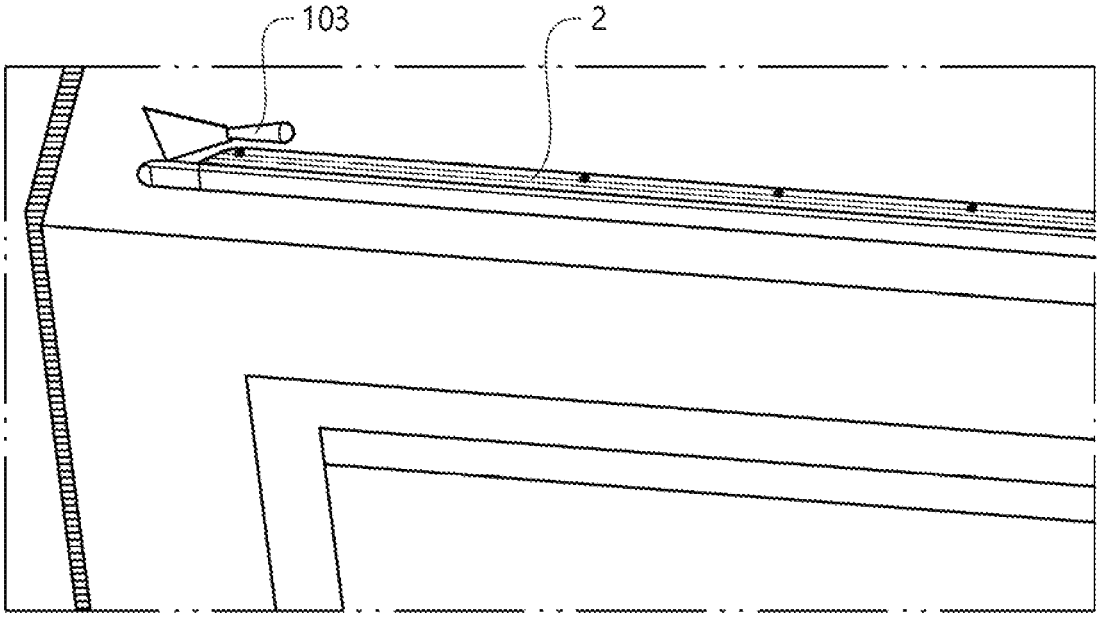
Figure 6E:
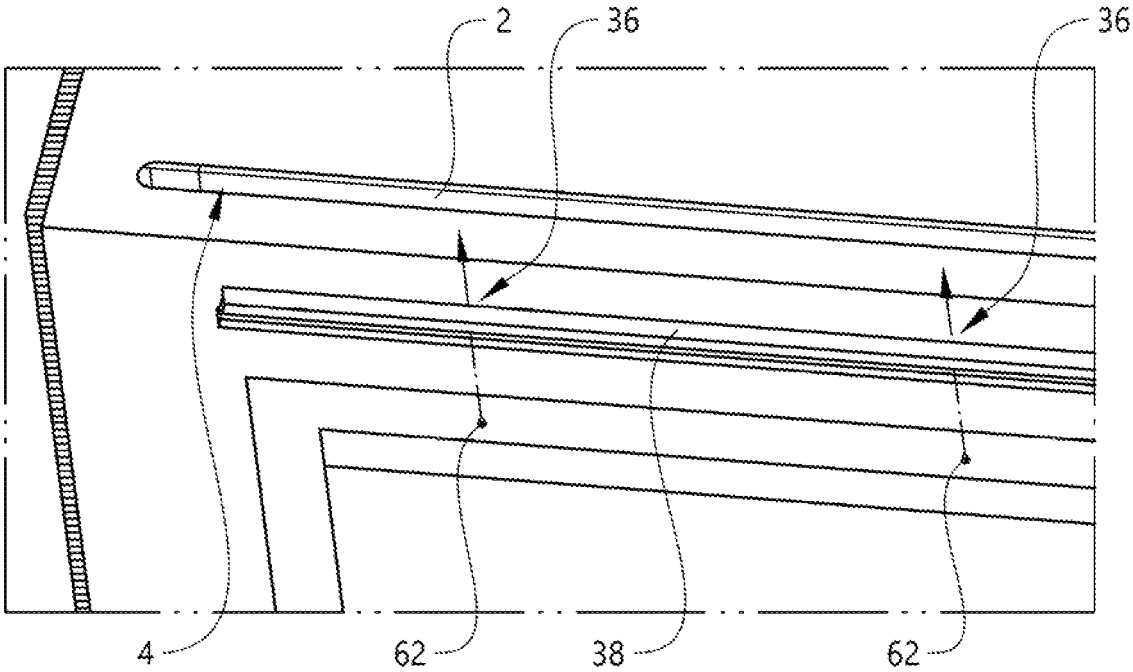
Figure 6F:
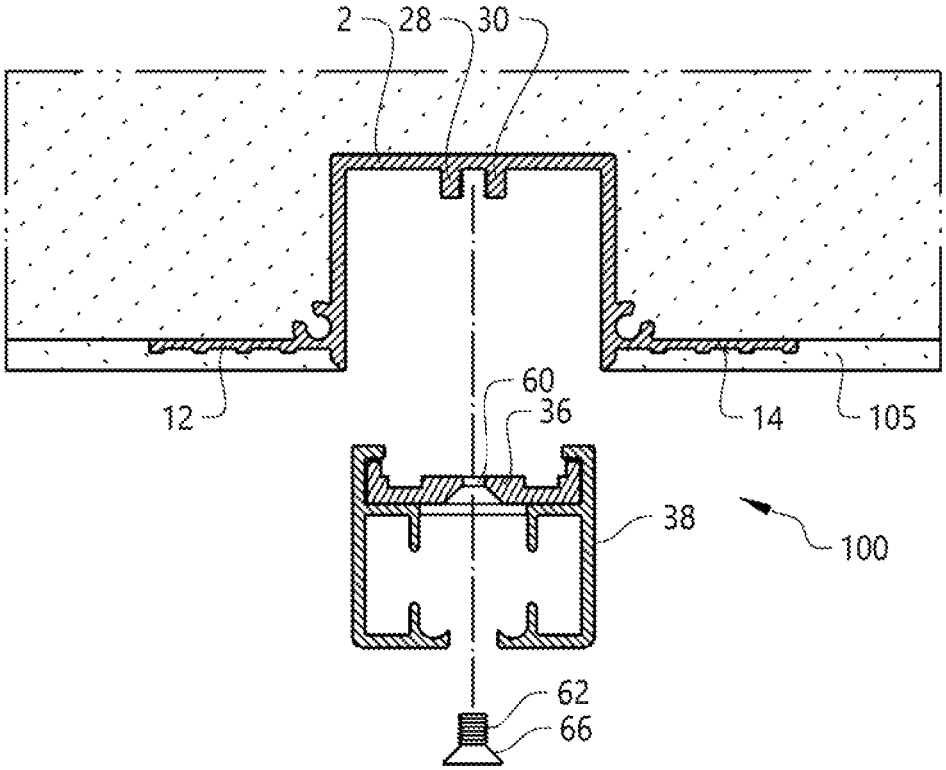
FIG. 6*f* is an exploded view in cross section of the assembly of the drapery system according to FIG. 6*a-e*.

FIG. 6*d* discloses the step of applying a skim plaster coat 105, see FIG. 6*f*, via a tool 103, outside the skim coat flanges 12,14 thereby concealing the elongate support member 2 in the elongate ceiling opening 98 in the ceiling.

Figure 6G:
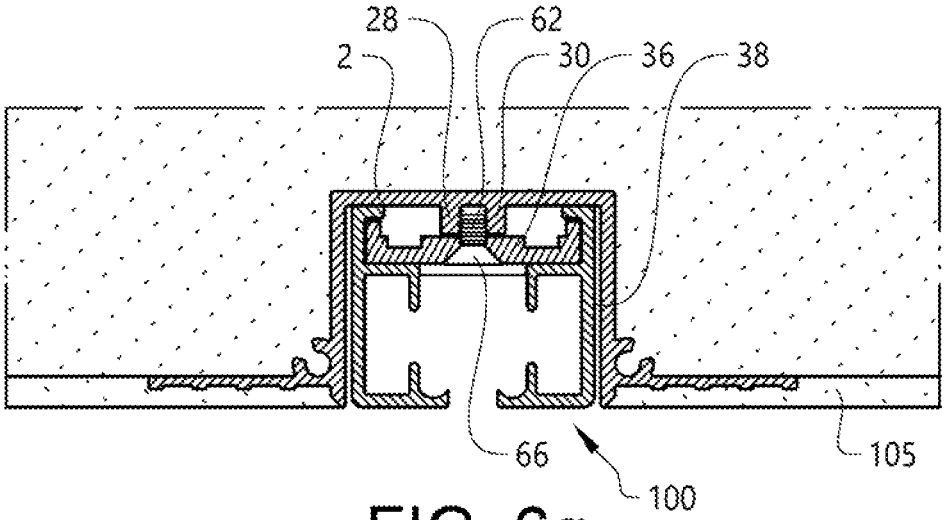
FIG. 6*g* is a cross section view of the drapery track according to FIG. 6*f* in an assembled state.

FIG. 6*e* discloses the step of positioning the drapery track 38 with the engaged connection structure 36 (hidden) into the elongate space 4 of the elongate support member 2. FIG. 6*e* and FIG. 6*f* further discloses the step of connecting the drapery track 38 to the elongate support member 2 by fastening the connection structure 36 to the elongate support member 2 by means of the fasteners 62 via the elongate slot 74 of the drapery track. FIG. 6*g* is a cross section view of the drapery track 38 according to FIG. 6*f* in an assembled state.

Figure 7:
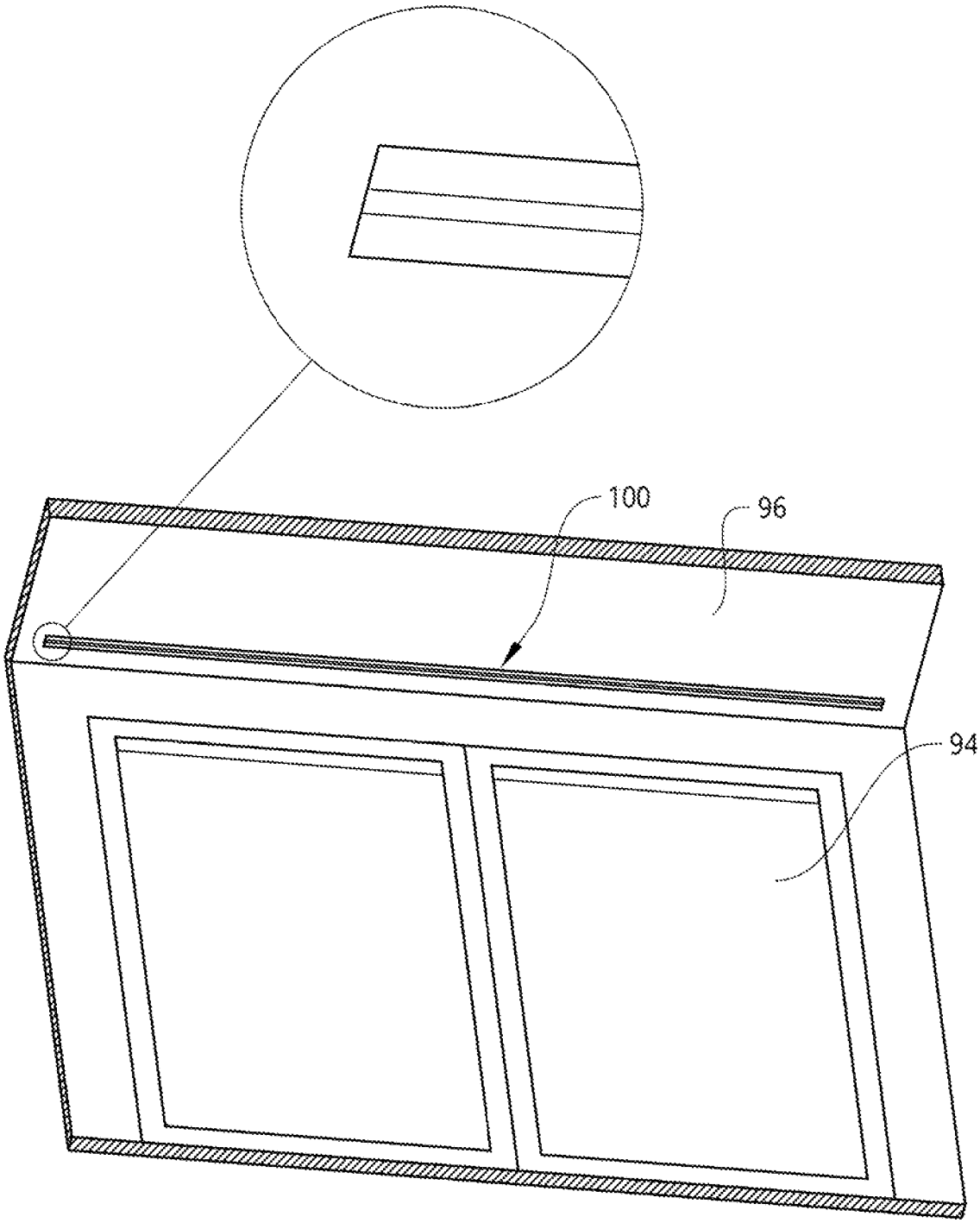
FIG. 7 is a perspective view from below of a part of a room, comprising a window and a ceiling, wherein a drapery system with end sections for manual operation is installed.

FIG. 7 is a perspective view from below of a part of a room, comprising a window and a ceiling, wherein the drapery system 100 devoid of any end sections is installed. This system is adapted for manual operation.

Figure 8:
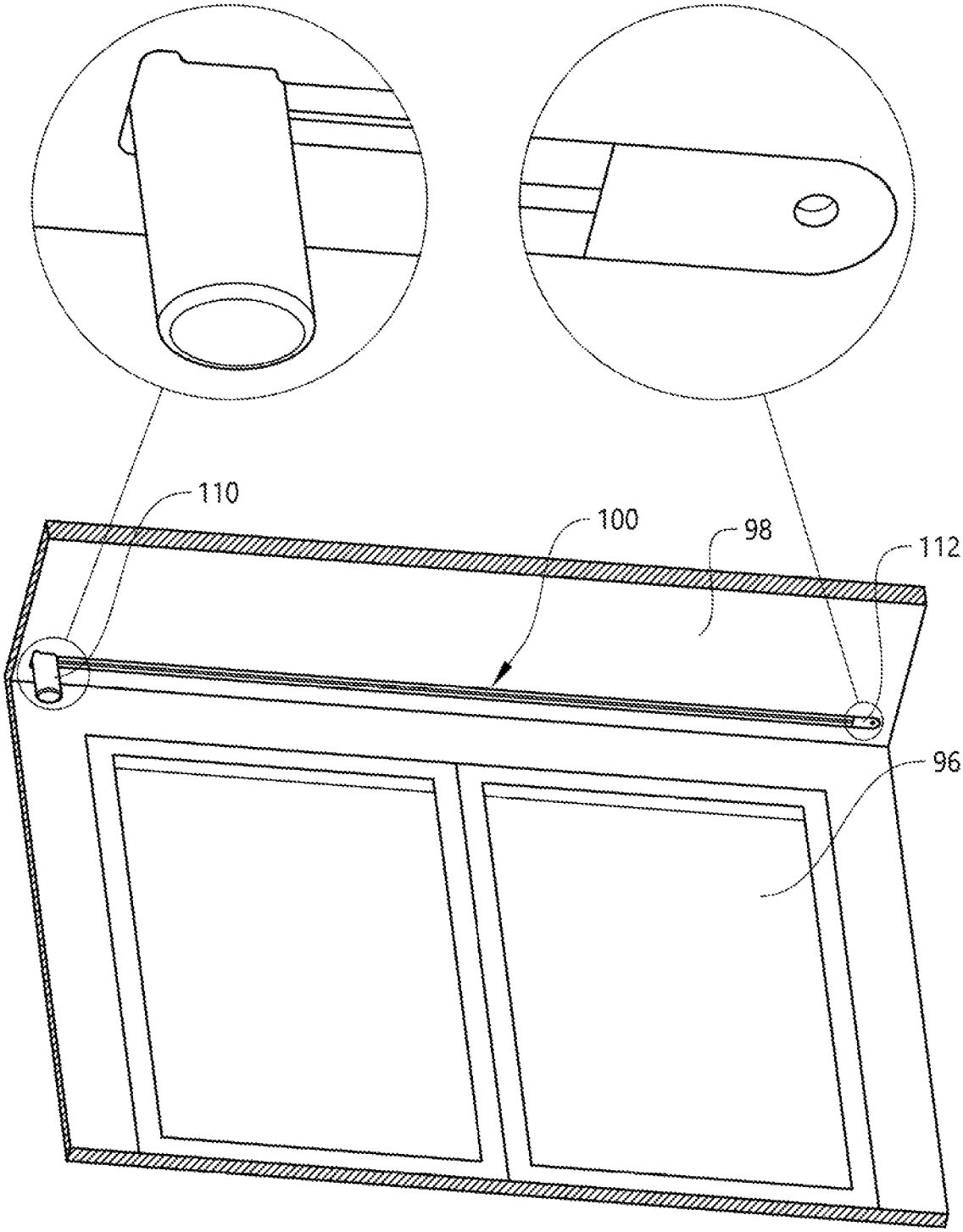
FIG. 8 is a perspective view from below of a part of a room, comprising a window and a ceiling, wherein a drapery system with end sections for motorized operation is installed.

FIG. 8 is a perspective view from below of a part of a room, comprising a window and a ceiling, wherein a drapery system 108 with end sections 110,112 for motorized operation is installed.

Figure 9A:
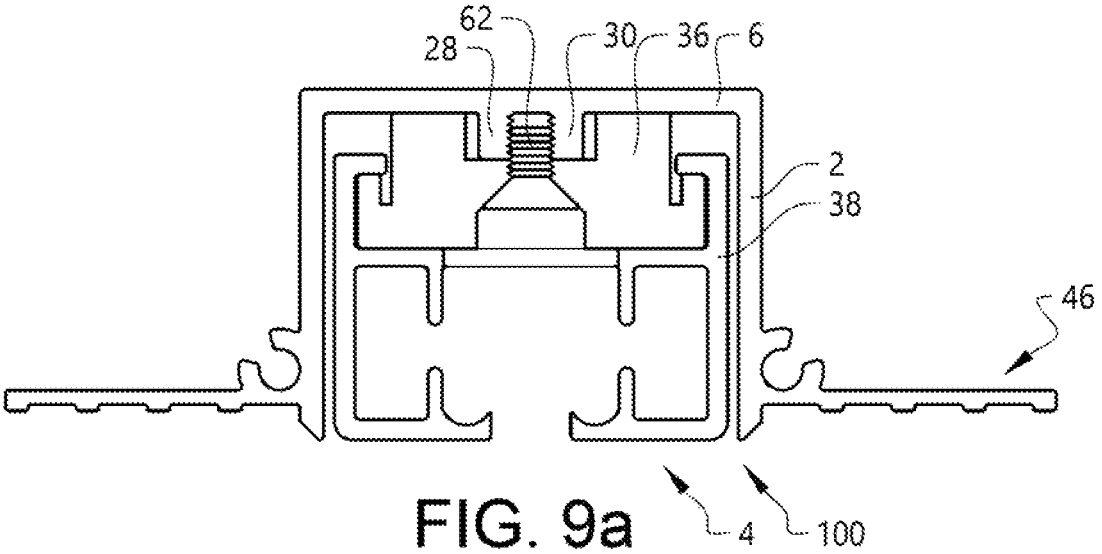
FIG. 9*a* is a cross section view of the drapery system according to the first embodiment.

FIG. 9*a* is a cross section view of the drapery system 100 according to the first embodiment.

A single design of the elongate support member 2 may be associated to a plurality of different designs of the connection structure so that a lower surface of the drapery track is flush with the ceiling irrespective of the height of the drapery track. In other words, the connection structure may be designed for a specific design of the drapery track.

Figure 9B:
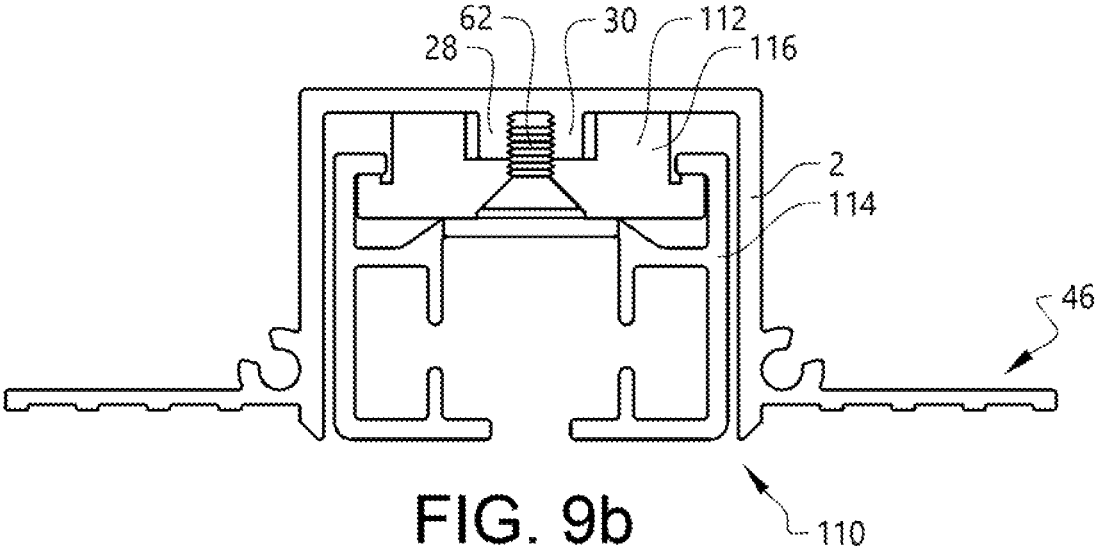
FIG. 9*b* is a cross section view of the drapery system according to a second embodiment.

FIG. 9*b* is a cross section view of a drapery system 110 according to a second embodiment. The drapery system 110 comprises a connection structure 112, which is adapted for a drapery track 114 of a larger height than the drapery track 38 of the first embodiment. The connection structure 112 comprises a first body 116 with a thickness in the height direction between opposite contact surfaces that compensates for the larger height of the drapery track 114 so that a lower surface of the drapery track 114 is flush with the lower surface 46 of the elongate support member 2.

Figure 9C:
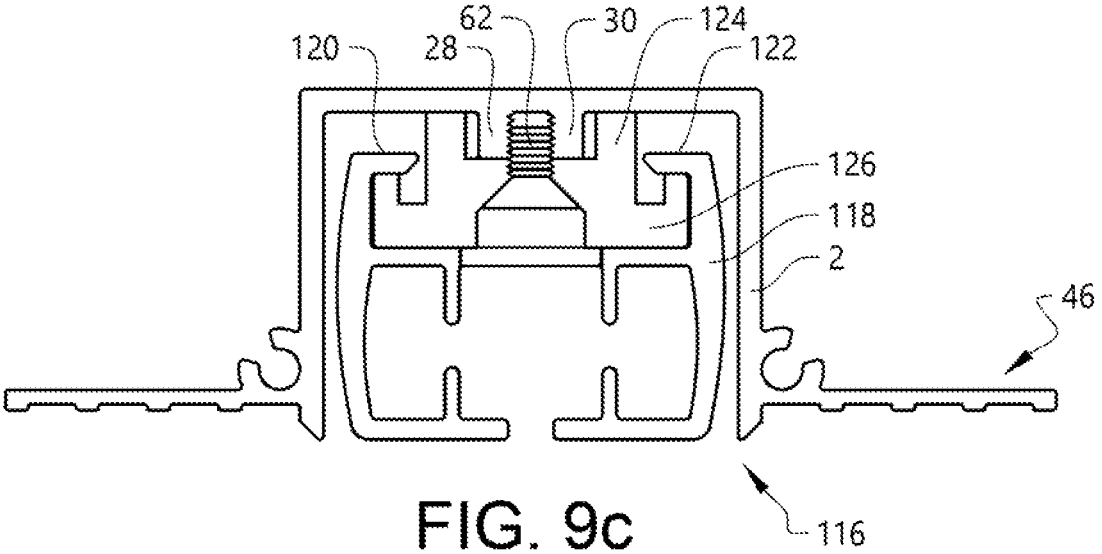
FIG. 9*c* is a cross section view of the drapery system according to a third embodiment.

FIG. 9*c* is a cross section view of the drapery system 116 according to a third embodiment. The drapery system 116 comprises a drapery track 118 of a design with a smaller width between the hooks 120,122 than a width between the hooks 54,56 of the drapery track 38 of the first embodiment. The drapery system 110 comprises a connection structure 124, which is adapted for the drapery track 118. The connection structure 112 comprises a first body 126 with a width that compensates for the smaller width between the hooks 120,122 of the drapery track 118.

Figure 10A:
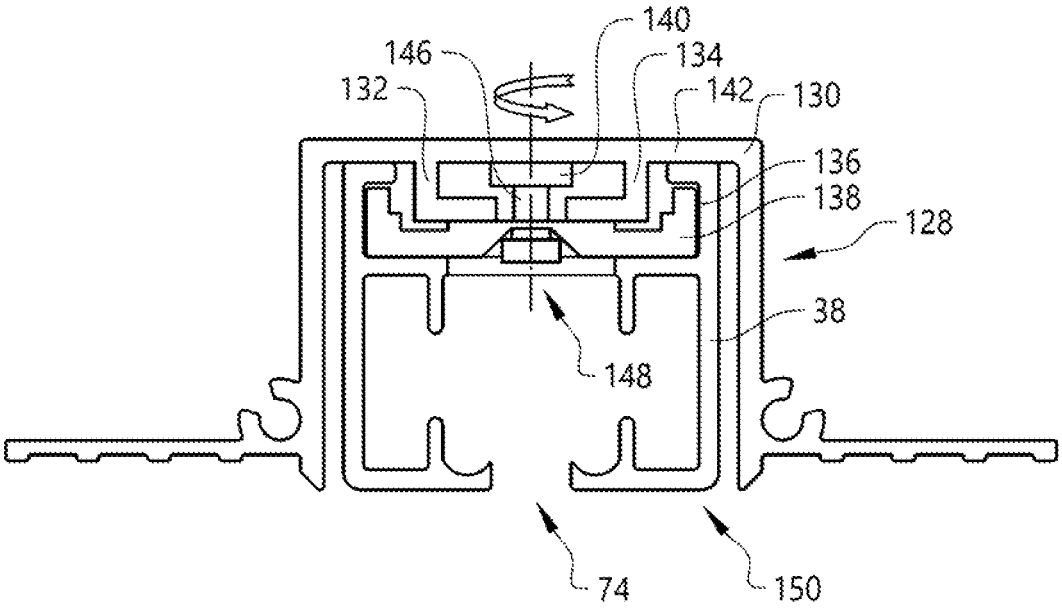
FIG. 10*a* is a cross section view of the drapery system according to a fourth embodiment in an intermediate assembly step.

FIG. 10*a* is a cross section view of a drapery system 128 according to a fourth embodiment in an intermediate assembly step. The drapery system 128 comprises an elongate support member 130 according to a second embodiment. The elongate support member 130 comprises a first elongate plate-shaped portion 142, which extends in a longitudinal direction of the elongate support member 130 and defines an elongate space 150 in one direction. The first elongate plate-shaped portion 142 forms a back wall. For ease of presentation, only the main differences relative to the first embodiment will be described. The elongate support member 130 comprises at least one connector 132,134 projecting from the first plate-shaped portion 142 in the elongate space. The connectors 132,134 form two parallel projections, each having a hook shape in cross section, wherein the hooks face each other.

The drapery system 128 further comprises a connection structure 136 according to a fifth embodiment. The connection structure 136 is adapted for at least partly being turned between a first assembly position, see FIG. 10*a*, and a second fixed position, see FIG. 10*b*, in a plane parallel to a plane defined by the hook shaped projections 132,134 for engagement with the hooks in the second fixed position. More specifically, the connection structure 136 comprises a first body 138 and a second body 140, which is pivotably arranged relative to the first body 136. The first body 138 may have a shape similar to the one described above for the first embodiment. The second body 140 comprises two spaced support surfaces 142,144 for engagement with the two hook shaped projections 132,134. Further, the connection structure 136 comprises a turning member 146, which is arranged in a through hole of the first body 136 so that it may be turned relative to the first body 136, see arrow. The turning member 146 is rigidly connected to the second body 140 and comprises an engagement means 148, which is accessible via the elongate slot 74 in the drapery track.

It is to be understood that the present invention is not limited to the embodiments described above and illustrated in the drawings; rather, the skilled person will recognize that many changes and modifications may be made within the scope of the appended claims.

According to the embodiments shown, only straight tracks have been disclosed. However, the invention is also applicable for tracks with a bent shape for curved applications.

Figure 10B:
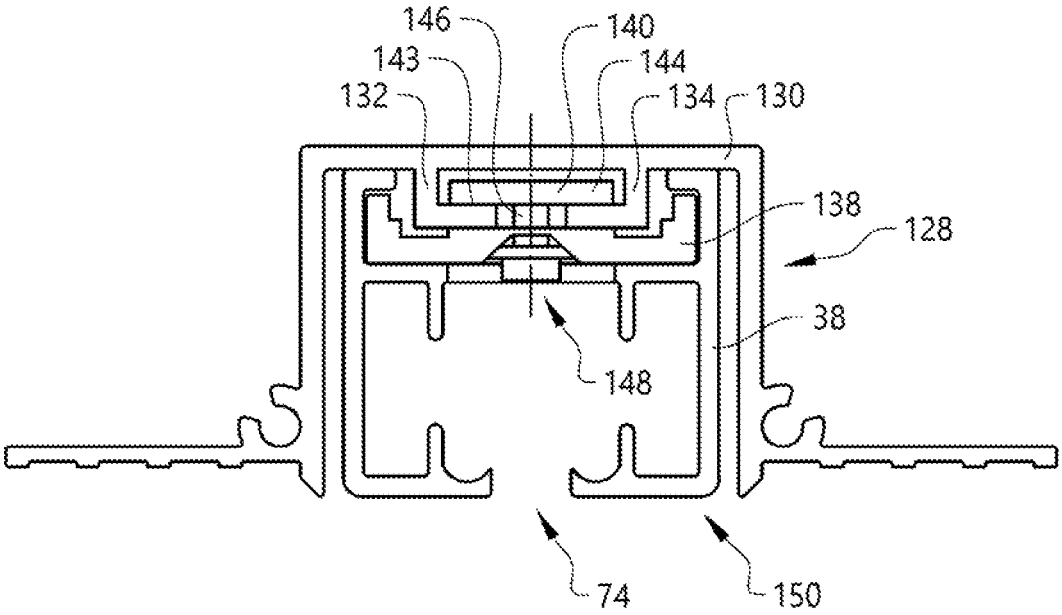
FIG. 10*b* is a cross section view of the drapery system according to the fourth embodiment in an assembled state.

According to an alternative to the second embodiment of the drapery system 128 in FIGS. 10*a* and 10*b*, the projecting connectors may be projecting from the side walls defining the elongate space instead of from the back wall defining the elongate space. Thus, according to one alternative, one of the projections may project from an inner surface of the second plate-shaped portion and the other projection may project from an inner surface of the third plate-shaped portion. In this embodiment, the connectors may form straight projections, ie not hook shaped projections.

According to an alternative to the first embodiment of the drapery system, the connection structure may comprise one elongate first body, which is adapted for being arranged in a longitudinal direction of the elongate support member, covering the distance of at least two through-holes spaced in the drapery track. According to one specific example, the connection structure comprises one single elongate first body, which is adapted for covering all through holes of the drapery track and possibly extend over the complete length the drapery track.

The invention claimed is:

1. A drapery system comprising an elongate support member, the elongate support member defining an elongate space for housing a drapery track, wherein the elongate support member comprises a first elongate plate-shaped portion that extends in a longitudinal direction of the elongate support member and that defines the elongate space in one direction, wherein the elongate support member comprises at least one connector projecting from the first plate-shaped portion in the elongate space, and wherein the drapery system comprises a connection structure, the connection structure being adapted for engagement with the drapery track and with the at least one connector, wherein the connection structure comprises a first body, the first body being adapted to be positioned between the drapery track and the first elongate plate-shaped portion of the elongate support member, and wherein the first body comprises a connection means that is accessible from a side of the first body and that is adapted to face the drapery track, wherein the connection structure is a spacer between the elongate support member and the drapery track, wherein the connection structure comprises a first contact surface for contacting an inner surface of the elongate support member in a first direction and a second contact surface for contacting the drapery track in a second direction, the second direction being opposite the first direction, and wherein the connection structure has an extension between the first contact surface and the second contact surface, wherein the connection means comprises a through-hole and wherein the connection structure comprises a fastener for being received in the through hole and fastening to the at least one connector of the elongate support member.

2. A drapery system according to claim 1, wherein the at least one connector is elongate and extends in a longitudinal direction of the elongate support member.

3. A drapery system according to claim 1, wherein the at least one connector comprises two parallel projections, the two parallel projections being spaced in a width direction of the elongate support member.

4. A drapery system according to claim 3, wherein the two parallel projections are spaced at such a distance that a fastener of screw-type may engage both projections simultaneously.

5. A drapery system comprising an elongate support member, the elongate support member defining an elongate space for housing a drapery track, wherein the elongate support member comprises a first elongate plate-shaped portion that extends in a longitudinal direction of the elongate support member and that defines the elongate space in one direction, wherein the elongate support member comprises at least one connector projecting from the first plate-shaped portion in the elongate space, and wherein the drapery system comprises a connection structure, the connection structure being adapted for engagement with the drapery track and with the at least one connector, wherein the connection structure comprises a first body, the first body being adapted to be positioned between the drapery track and the first elongate plate-shaped portion of the elongate support member, and wherein the first body comprises a connection means that is accessible from a side of the first body and that is adapted to face the drapery track, wherein the at least one connector comprises two parallel projections, the two parallel projections being spaced in a width direction of the elongate support member, wherein the two parallel projections are spaced at such a distance that a fastener of screw-type may engage both projections simultaneously, and wherein an inner surface of at least one of the two parallel projections, the inner surface of the at least one of the two parallel projections facing the other one of the two parallel projections, is provided with a ridge-valley configuration for facilitating engagement with the fastener.

6. A drapery system according to claim 5, wherein the connection structure is a spacer between the elongate support member and the drapery track, wherein the connection structure comprises a first contact surface for contacting an inner surface of the elongate support member in a first direction and a second contact surface for contacting the drapery track in a second direction, the second direction being opposite the first direction, and wherein the connection structure has an extension between the first contact surface and the second contact surface.

7. A drapery system according to claim 1, wherein the first body comprises two support surfaces, the two support surfaces being spaced in a width direction of the connection structure, for engagement with two engagement hooks projecting, from the drapery track facing each other.

8. A drapery system according to claim 5, wherein the connection means comprises a through-hole and wherein the connection structure comprises a fastener for being received in the through hole and fastening to the at least one connector of the elongate support member.

9. A drapery system according to claim 1, wherein the connection means comprises a widened recess at an end of the through hole, the through hole being adapted for facing the drapery track for receipt of a head of the fastener.

10. A drapery system according to claim 1, wherein the connection structure comprises a plurality of first bodies, the plurality of first bodies being adapted for being arranged in a spaced relationship in a longitudinal direction of the elongate support member, wherein the spacing is matched to a through-hole spacing in the drapery track.

11. A drapery system comprising an elongate support member, the elongate support member defining an elongate space for housing a drapery track, wherein the elongate support member comprises a first elongate plate-shaped portion that extends in a longitudinal direction of the elongate support member and that defines the elongate space in one direction, wherein the elongate support member comprises at least one connector projecting from the first plate-shaped portion in the elongate space, and wherein the drapery system comprises a connection structure, the connection structure being adapted for engagement with the drapery track and with the at least one connector, wherein the connection structure comprises a first body, the first body being adapted to be positioned between the drapery track and the first elongate plate-shaped portion of the elongate support member, and wherein the first body comprises a connection means that is accessible from a side of the first body and that is adapted to face the drapery track, wherein the at least one connector comprises two parallel projections, the two parallel projections being spaced in a width direction of the elongate support member, wherein the connection structure is a spacer between the elongate support member and the drapery track, wherein the connection structure comprises a first contact surface for contacting an inner surface of the elongate support member in a first direction and a second contact surface for contacting the drapery track in a second direction, the second direction being opposite the first direction, and wherein the connection structure has an extension between the first contact surface and the second contact surface and wherein each one of the two parallel projections have a hook shape in cross section, wherein the hooks face each other.

12. A drapery system according to claim 11, wherein the connection structure is adapted for at least partly being turned between a first assembly position and a second fixed position in a plane parallel to a plane defined by the hook shaped projections for engagement with the hooks in the second fixed position.

13. A drapery system according to claim 12, wherein the connection structure comprises a second body, the second body being pivotably arranged relative to the first body and wherein the second body comprises two spaced support surfaces for engagement with the two hook shaped projections projecting from the first plate-shaped portion.

14. A drapery system comprising an elongate support member, the elongate support member defining an elongate space for housing a drapery track, wherein the elongate support member comprises a first elongate plate-shaped portion that extends in a longitudinal direction of the elongate support member and that defines the elongate space in one direction, wherein the elongate support member comprises at least one connector projecting from the first plate-shaped portion in the elongate space, and wherein the drapery system comprises a connection structure, the connection structure being adapted for engagement with the drapery track and with the at least one connector, wherein the connection structure comprises a first body, the first body being adapted to be positioned between the drapery track and the first elongate plate-shaped portion of the elongate support member, and wherein the first body comprises a connection means that is accessible from a side of the first body and that is adapted to face the drapery track, wherein the first plate-shaped portion forms a back section of the elongate support member and wherein the elongate support member comprises a second and a third plate-shaped portion, the second and the third plate-shaped portion extending perpendicularly relative to the first plate-shaped portion and being spaced in a width direction of the elongate support member, and wherein the first, second and third plate-shaped portions define the elongate space.

15. A drapery system according to claim 14, wherein the drapery system comprises the drapery track and wherein the spacing between the second and the third plate-shaped portion in the width direction of the elongate support member is the same or somewhat larger than an extension of the drapery track in its width direction for a close fit of the drapery track between the second and third plate-shaped portions.

16. A drapery system comprising an elongate support member, the elongate support member defining an elongate space for housing a drapery track, wherein the elongate support member comprises a first elongate plate-shaped portion that extends in a longitudinal direction of the elongate support member and that defines the elongate space in one direction, wherein the elongate support member comprises at least one connector projecting from the first plate-shaped portion in the elongate space, and wherein the drapery system comprises a connection structure, the connection structure being adapted for engagement with the drapery track and with the at least one connector, wherein the connection structure comprises a first body, the first body being adapted to be positioned between the drapery track and the first elongate plate-shaped portion of the elongate support member, and wherein the first body comprises a connection means that is accessible from a side of the first body and that is adapted to face the drapery track, wherein the first plate-shaped portion forms a back section of the elongate support member and wherein the elongate support member comprises a second and a third plate-shaped portion, the second and the third plate-shaped portion extending perpendicularly relative to the first plate-shaped portion and being spaced in a width direction of the elongate support member and wherein the first, second and third plate-shaped portions define the elongate space, and wherein the drapery system is adapted for use with a drapery track of a type comprising an elongate slot, which slot is adapted for receipt of drapery runners, and wherein the drapery track is adapted to be positioned in such a way relative to the connection structure that the connection means of the connection structure is accessible via the elongate slot.

17. A drapery system comprising an elongate support member, the elongate support member defining an elongate space for housing a drapery track, wherein the elongate support member comprises a first elongate plate-shaped portion that extends in a longitudinal direction of the elongate support member and that defines the elongate space in one direction, wherein the elongate support member comprises at least one connector projecting from the first plate-shaped portion in the elongate space, and wherein the drapery system comprises a plurality of interchangeable, different connection structures, each connection structure of the plurality of different connection structures being adapted for engagement with the drapery track and with the at least one connector, wherein each connection structure of the plurality of different connection structures is a spacer between the elongate support member and the drapery track, wherein each connection structure of the plurality of different connection structures comprises a first contact surface for contacting an inner surface of the elongate support member in a first direction and a second contact surface for contacting the drapery track in a second direction, the second direction being opposite the first direction, and wherein each connection structure of the plurality of different connection structures has an extension between the first contact surface and the second contact surface that is different from the extension between the first contact surface and the second contact surface of any other connection structure of the plurality of different connection structures.

* * * * *